US011808006B2

(12) United States Patent
Oasa et al.

(10) Patent No.: US 11,808,006 B2
(45) Date of Patent: Nov. 7, 2023

(54) WORK VEHICLE WITH AUTOMATIC DUMP AND TILT CONTROL AND METHOD FOR AUTOMATICALLY CONTROLLING DUMP AND TILT OPERATIONS OF WORK VEHICLE

(71) Applicant: KOMATSU LTD., Tokyo (JP)

(72) Inventors: Takahisa Oasa, Tokyo (JP); Kiyotaka Ninomiya, Tokyo (JP)

(73) Assignee: KOMATSU LTD., Tokyo (JP)

( * ) Notice: Subject to any disclaimer, the term of this patent is extended or adjusted under 35 U.S.C. 154(b) by 593 days.

(21) Appl. No.: 16/490,292

(22) PCT Filed: Sep. 28, 2018

(86) PCT No.: PCT/JP2018/036428
§ 371 (c)(1),
(2) Date: Aug. 30, 2019

(87) PCT Pub. No.: WO2019/066025
PCT Pub. Date: Apr. 4, 2019

(65) Prior Publication Data

US 2021/0285182 A1 Sep. 16, 2021

(30) Foreign Application Priority Data

Sep. 29, 2017 (JP) ..... 2017-190387

(51) Int. Cl.
*E02F 3/43* (2006.01)
*E02F 3/28* (2006.01)
(Continued)

(52) U.S. Cl.
CPC ..... *E02F 3/434* (2013.01); *E02F 3/283* (2013.01); *E02F 9/20* (2013.01); *E02F 9/2004* (2013.01);
(Continued)

(58) Field of Classification Search
CPC ... E02F 3/283; E02F 3/434; E02F 3/84; E02F 9/20; E02F 9/2004; E02F 9/2203; E02F 9/2285; E02F 9/2292
(Continued)

(56) References Cited

U.S. PATENT DOCUMENTS 3,726,428 A * 4/1973 Lark ..... E02F 3/432 414/700
4,969,527 A * 11/1990 Boe ..... A01B 63/1006 172/2
(Continued)

FOREIGN PATENT DOCUMENTS

CN 1748080 A 3/2006
CN 104066898 A 9/2014
(Continued)

OTHER PUBLICATIONS

The International Search Report for the corresponding international application No. PCT/JP2018/036428, dated Dec. 18, 2018.
(Continued)

*Primary Examiner* — Geepy Pe
*Assistant Examiner* — Sean Patrick Reidy
(74) *Attorney, Agent, or Firm* — Global IP Counselors, LLP

(57) ABSTRACT

A work vehicle includes a vehicle body, a work implement including an attachment, an operating device and a controller. The operating device can be operated to a dump side and a tilt side to cause the attachment to dump and tilt. The controller executes an automatic drive control in which the attachment is caused to dump as far as a predetermined dumping position when the operating device is operated by a first dump operation amount or greater to the dump side, or to tilt as far as a predetermined tilt position when the operating device is operated by a first tilt operation amount
(Continued)

or greater to the tilt side. The controller disables the automatic drive control when a switching time period required for the operating device to be switched between the tilt and dump sides is at least a predetermined disabling time period.

13 Claims, 4 Drawing Sheets

(51) Int. Cl.
*E02F 9/20* (2006.01)
*E02F 9/22* (2006.01)

(52) U.S. Cl.
CPC ..... *E02F 9/2203* (2013.01); *E02F 9/2285* (2013.01); *E02F 9/2292* (2013.01)

(58) Field of Classification Search
USPC ..... 701/50
See application file for complete search history.

(56) References Cited

U.S. PATENT DOCUMENTS

| | | | | |
|---|---|---|---|---|
| 5,642,653 | A | 7/1997 | Hutchison | |
| 6,266,596 | B1 | 7/2001 | Hartman et al. | |
| 6,405,114 | B1 * | 6/2002 | Priestley | B66F 11/046 701/50 |
| 2002/0073833 | A1 * | 6/2002 | Coombs | E02F 3/434 91/35 |
| 2006/0118084 | A1 | 6/2006 | Asakage | |
| 2006/0184302 | A1 | 8/2006 | Ikari | |
| 2014/0343805 | A1 | 11/2014 | Suk | |
| 2015/0134209 | A1 * | 5/2015 | Lee | E02F 9/221 701/50 |
| 2015/0299986 | A1 | 10/2015 | Ikegami et al. | |
| 2016/0145827 | A1 * | 5/2016 | Kami | E02F 3/30 701/50 |
| 2016/0369479 | A1 | 12/2016 | Tanaka et al. | |
| 2018/0100290 | A1 * | 4/2018 | Greer | E02F 3/3414 |

FOREIGN PATENT DOCUMENTS

| | | | |
|---|---|---|---|
| CN | 104246428 | A | 12/2014 |
| EP | 2 949 822 | A1 | 12/2015 |
| GB | 2 186 999 | A | 8/1987 |
| JP | 63-151555 | U | 10/1988 |
| JP | 9-133105 | A | 5/1997 |
| JP | 2001-271372 | A | 10/2001 |
| JP | 2004-245205 | A | 9/2004 |

OTHER PUBLICATIONS

The Office Action for the corresponding Chinese application No. 201880016631.9, dated Jan. 27, 2021.
The extended European search report for the corresponding European application No. 18860879.8, dated Oct. 2, 2020.

* cited by examiner

WORK VEHICLE WITH AUTOMATIC DUMP AND TILT CONTROL AND METHOD FOR AUTOMATICALLY CONTROLLING DUMP AND TILT OPERATIONS OF WORK VEHICLE

CROSS-REFERENCE TO RELATED APPLICATION

This application is a U.S. National Stage application of International Application No. PCT/JP2018/036428, filed Sep. 28, 2018, which claims priority to Japanese Patent Application No. 2017-190387, filed Sep. 29, 2017, the contents of each of which are hereby incorporated herein by reference.

BACKGROUND

Field of Invention

The present invention relates to a work vehicle and a control method for the work vehicle.

Background Information

Conventionally, an automatic drive control (a so-called detente control) is performed in a work vehicle such as a wheel loader or a bulldozer by automatically causing an attachment to be driven to a predetermined position for the purpose of repeatedly moving the attachment to the predetermined position easily and accurately (see Japanese Patent Application Laid-Open No. H09-133105).

The automatic drive control described in Japanese Patent Application Laid-Open No. H09-133105 is executed by tilting an operating lever for an attachment to a tilt side or a dump side by a predetermined amount or greater and then returning the operating lever to a neutral region.

SUMMARY

However, the operator may nimbly operate the operating lever by small increments to the tilt side or the dump side to swing the attachment back and forth in order to even out and mix the load in the attachment. In this case, if the operating lever is tilted by the predetermined amount or greater to the tilt side or the dump side by mistake, the automatic drive control of the attachment is executed without the intention of the operator.

Taking into account the above problem, an object of the present invention is to provide a work vehicle and a control method for a work vehicle with which the operability of the attachment can be improved.

A work vehicle according to the present invention is provided with a vehicle body, a work implement, an operating device, and a controller. The work implement is attached to the vehicle body and includes an attachment. The operating device can be operated to a dump side for causing the attachment to dump and to a tilt side for causing the attachment to tilt. The controller executes an automatic drive control for automatically causing the attachment to dump as far as a predetermined dump position when the operating device is operated by a first dump operation amount or greater to the dump side, and for automatically causing the attachment to tilt as far as a predetermined tilt position when the operating device is operated by a first tilt operation amount or greater to the tilt side. The controller disables the automatic drive control when a switching time period required for the operating device to be switched from the tilt side to the dump side or from the dump side to the tilt side, is equal to or less than a predetermined disabling time period.

According to the present invention, a work vehicle and a control method for a work vehicle can be provided with which the operability of the attachment can be improved.

DETAILED DESCRIPTION OF EMBODIMENT(S)

An example of a "work vehicle" to which an "automatic drive control" according to the present invention is applied will be explained hereinbelow with reference to the drawings. However, the scope of the present invention is not limited to the following embodiments and may be changed as desired within the scope of the technical concept of the present invention. For example, while a wheel loader provided with a bucket as the attachment is cited as an example in the following explanations, the "automatic drive control" according to the present invention can be widely applied to a work vehicle provided with a bucket. In addition to a wheel loader, a hydraulic excavator, or the like can be cited as the work vehicle. In addition to a bucket, a fork, a grapple, or the like can be cited as the attachment.

In the present description, "front" is a term that indicates the forward direction of the work vehicle, and "rear" indicates the reverse direction of the work vehicle. In addition, "left" and "right" are terms relative to the traveling direction when the work vehicle is traveling forward.

Wheel Loader 1

Figure 1:
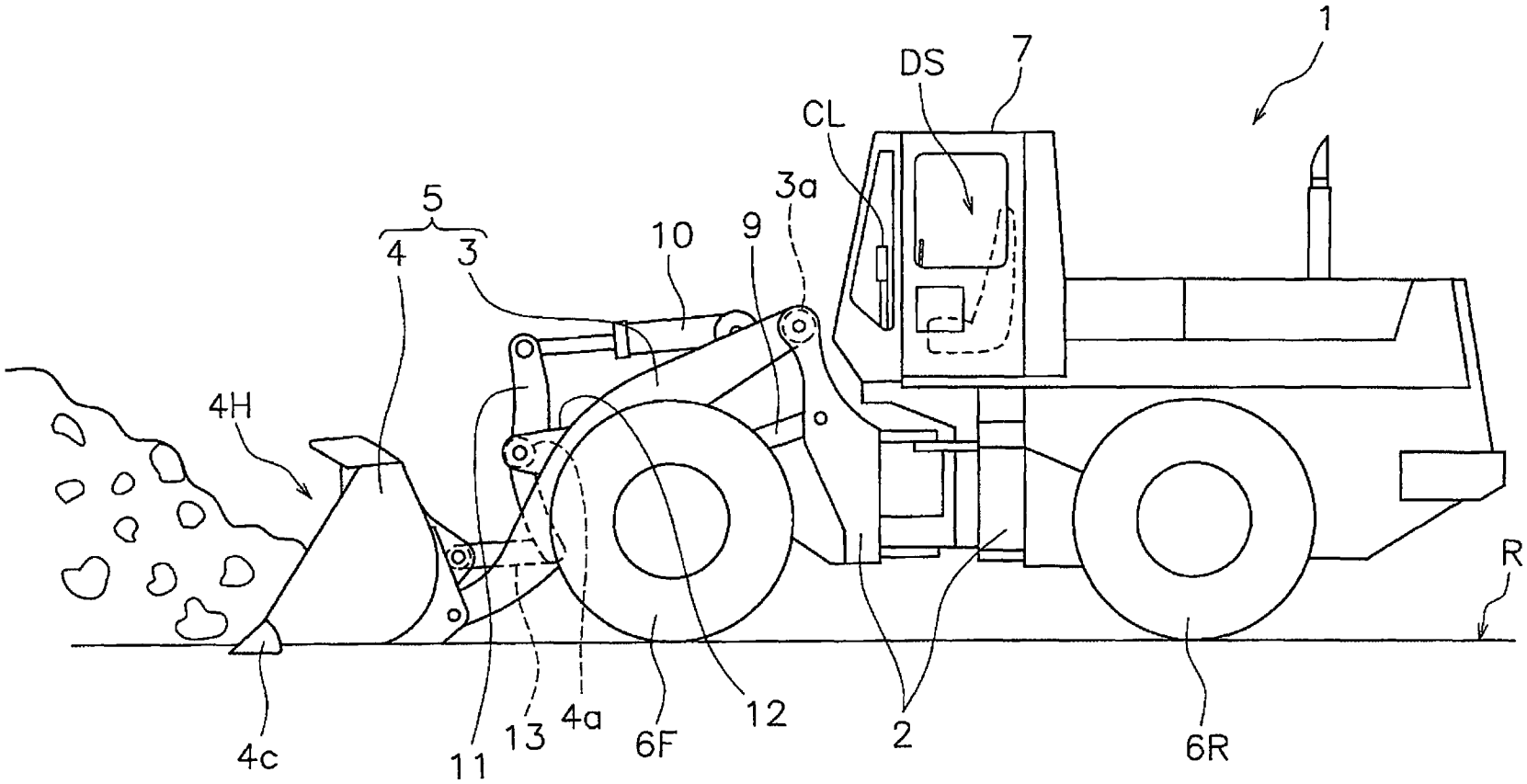
FIG. 1 is side view of a wheel loader.

FIG. 1 is a side view of a wheel loader 1 according to the present embodiment.

The wheel loader 1 is provided with a vehicle body 2, a work implement 5, front wheels 6F, rear wheels 6R, an operating cabin 7, a boom cylinder 9, and a bucket cylinder 10.

The work implement, the front wheels 6F, the rear wheels 6R, and the operating cabin 7 are attached to the vehicle body 2. An operator's seat DS on which the operator sits, and an operating lever CL (example of an operating device) for operating the work implement 5 are disposed inside the operating cabin 7.

The work implement 5 is attached at the front of the vehicle body 2. The work implement 5 has a boom 3 and a bucket 4. The boom 3 extends from the vehicle body 2 in the forward direction. The boom 3 is supported by the vehicle body 2 in a manner that allows swinging up and down.

The bucket 4 has an opening part 4H and a claw 4C. The bucket 4 scoops a load of sand or gravel and the like with the claw 4C. The load scooped with the claw 4C enters into the bucket 4 from the opening part 4H. The bucket 4 is attached to the tip end of the boom 3. The bucket 4 is supported by the boom 3 in a manner that allows tilting forward and backward. In the present description, causing the bucket 4 to be rotated in a backward inclined direction is called "tilting"

and causing the bucket 4 to be rotated in a forward inclined direction is called "dumping."

The front wheels 6F and the rear wheels 6R are in contact with a road surface R. The wheel loader 1 travels due to the front wheels 6F and the rear wheels 6R rotating on the road surface R. The wheel loader 1 is steered due to the vehicle body 2 bending between the front wheels 6F and the rear wheels 6R.

The boom cylinder 9 is coupled to the vehicle body 2 and the boom 3. The boom 3 swings up and down due to the extension and contraction of the boom cylinder 9. The bucket cylinder 10 is coupled to the vehicle body 2 and an upper end part of a bell crank 11. The bell crank 11 is rotatably supported at the tip end part of a supporting member 12 that is fixed to the boom 3. A lower end part of the bell crank 11 is coupled to the bucket 4 via a coupling member 13. The bucket 4 tilts and dumps forward and backward around a portion supported by the boom 3 due to the extension and contraction of the bucket cylinder 10.

The operating lever CL is used for raising and lowering (swinging up and down) the boom 3 due to the extension and contraction of the boom cylinder 9. In the present embodiment, the boom 3 is lowered when the operating lever CL is operated (tilted) to the down side (forward in the present embodiment) in relation to a neutral position. The boom 3 is raised when the operating lever CL is operated (tilted) to the up side (backward in the present embodiment) in relation to the neutral position. The boom 3 is stopped when the operating lever CL is positioned in the neutral position.

The operating lever CL is used for tilting or dumping the bucket 4 due to the extension and contraction of the bucket cylinder 10. The operating lever CL can be operated to a tilt side in which the bucket 4 is tilted, and to a dump side in which the bucket 4 is dumped. In the present embodiment, the bucket 4 is tilted when the operating lever CL is operated (tilted) to the tilt side (leftward in the present embodiment) in relation to the neutral position. In addition, the bucket 4 is dumped when the operating lever CL is operated (tilted) to the dump side (rightward in the present embodiment) in relation to the neutral position. The bucket 4 is stopped when the operating lever CL is positioned in the neutral position.

Control system of wheel loader 1

Figure 2:
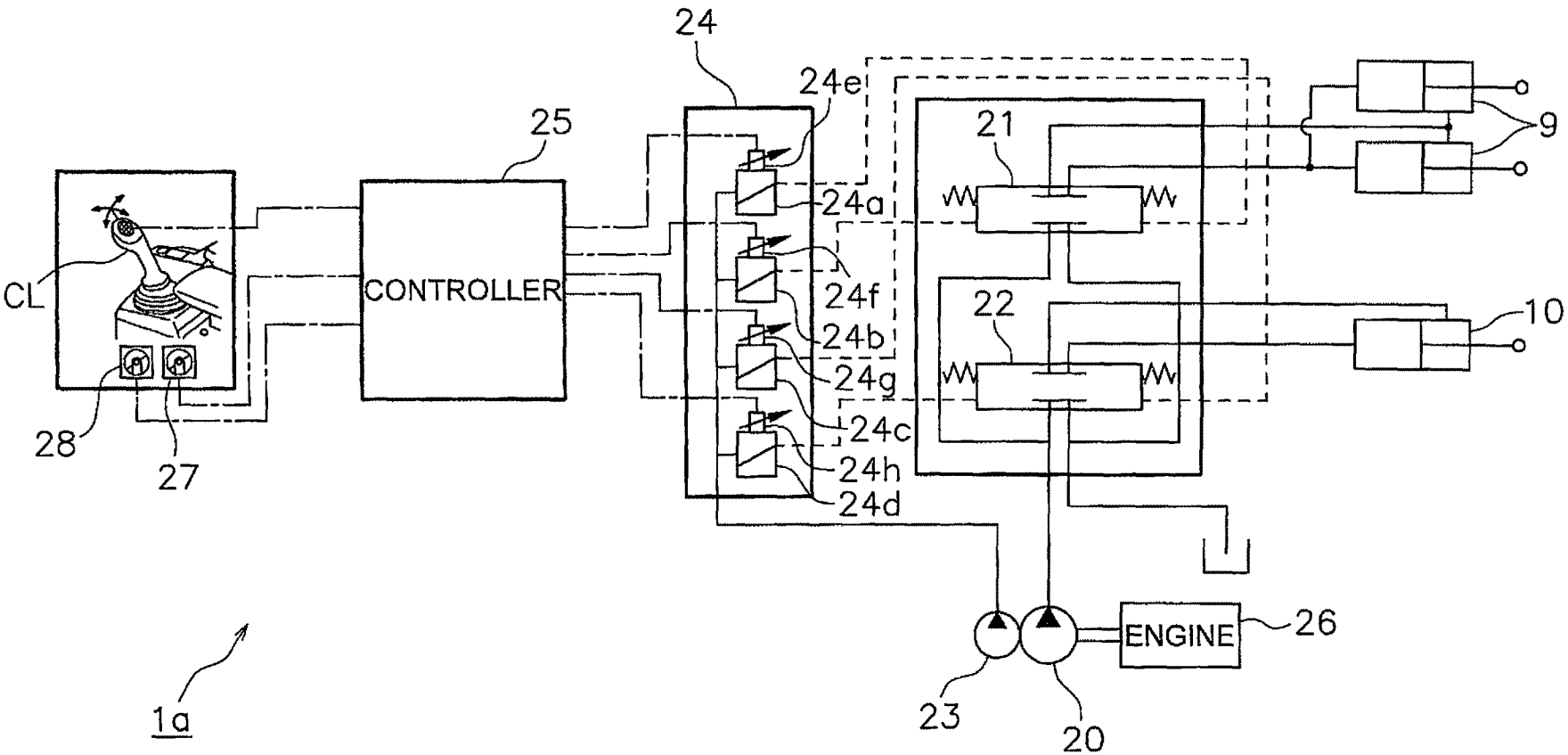
FIG. 2 is a block diagram illustrating a control system of the wheel loader.

FIG. 2 is a block diagram illustrating a control system 1*a* for controlling the operations of the wheel loader 1.

The control system 1*a* of the wheel loader 1 is provided with a work implement pump 20, a boom operation valve 21, a bucket operation valve 22, a pilot pump 23, a work implement electronic control valve 24, and a controller 25.

The work implement pump 20 is driven by an engine 26 as a drive force generation source mounted in the wheel loader 1. The work implement pump 20 discharges hydraulic fluid to the boom operation valve 21 and the bucket operation valve 22.

The boom operation valve 21 and the bucket operation valve 22 are both hydraulic pilot-type operation valves. The boom operation valve 21 is connected to the boom cylinder 9 and the bucket operation valve 22 is connected to the bucket cylinder 10.

The boom operation valve 21 is a three position switching valve that is able to switch between a position for raising the boom 3, a position for stopping the boom 3, and a position for lowering the boom 3. The bucket operation valve 22 is a three position switching valve that is able to switch between a position for dumping the bucket 4, a position for stopping the bucket 4, and a position for tilting the bucket 4.

The respective pilot pressure receiving parts of the boom operation valve 21 and the bucket operation valve 22 are connected to the work implement electronic control valve 24 via the pilot pump 23. The pilot pump 23 is driven by the engine 26. The pilot pump 23 supplies hydraulic fluid at a pilot pressure to the respective pilot pressure receiving parts of the boom operation valve 21 and the bucket operation valve 22 via the work implement electronic control valve 24.

The work implement electronic control valve 24 has a boom lowering control valve 24*a*, a boom raising control valve 24*b*, a bucket dump control valve 24*c*, and a bucket tilt control valve 24*d*. The boom lowering control valve 24*a* and the boom raising control valve 24*b* are connected respectively to a pair of pilot pressure receiving parts of the boom operation valve 21. The bucket dump control valve 24*c* and the bucket tilt control valve 24*d* are connected respectively to a pair of pilot pressure receiving parts of the bucket operation valve 22. Command signals from the controller 25 are inputted respectively to a solenoid command part 24*e* of the boom lowering control valve 24*a*, a solenoid command part 24*f* of the boom raising control valve 24*b*, a solenoid command part 24*g* of the bucket dump control valve 24*c*, and a solenoid command part 24*h* of the bucket tilt control valve 24*d*.

The boom operation valve 21, the boom lowering control valve 24*a*, the boom raising control valve 24*b*, and the boom cylinder 9 function as a boom driving part for raising and lowering the boom 3. The bucket operation valve 22, the bucket dump control valve 24*c*, the bucket tilt control valve 24*d*, and the bucket cylinder 10 function as a bucket driving part for tilting and dumping the bucket 4.

The controller 25 is, for example, a computer. The controller 25 includes a processing part such as a central processing unit (CPU) or the like, and a storage unit such as a read only memory (ROM) or the like. The controller 25 controls the operation of the work implement 5 by consecutively executing various commands stored in a computer program.

The controller 25 is connected to a boom lever potentiometer 27 and a bucket lever potentiometer 28. The boom lever potentiometer 27 is provided to the operating lever CL. The boom lever potentiometer 27 detects the operation amount (amount of tilt) of the operating lever CL to the raising side or the lowering side. The bucket lever potentiometer 28 is provided to the operating lever CL. The bucket lever potentiometer 28 detects the operation amount (amount of tilt) of the operating lever CL to the tilt side or the dump side.

The controller 25 stops the boom 3 by switching the boom operation valve 21 to the position for stopping the boom 3 when the operating lever CL is moved to the neutral position between the raising side and the lowering side. The controller 25 lowers the boom 3 at a driving speed in accordance with the operation amount of the operating lever CL by switching the boom operation valve 21 to the position for lowering the boom 3 when the operating lever CL is moved to the lowering side. The controller 25 raises the boom 3 at a driving speed in accordance with the operation amount of the operating lever CL by switching the boom operation valve 21 to the position for raising the boom 3 when the operating lever CL is moved to the raising side.

The controller 25 stops the bucket 4 by switching the bucket operation valve 22 to the position for stopping the bucket 4 when the operating lever CL is moved to the neutral position between the tilt side and the dump side. The controller 25 tilts the bucket 4 at a driving speed in accordance with the operation amount of the operating lever CL by switching the bucket operation valve 22 to the position for tilting the bucket 4 when the operating lever CL is moved to the tilt side. The controller 25 dumps the bucket 4 at a driving speed in accordance with the operation amount of the operating lever CL by switching the bucket operation valve 22 to the position for dumping the bucket 4 when the operating lever CL is moved to the dump side.

The controller 25 executes an "automatic drive control" for automatically tilting the bucket 4 as far as a predetermined tilt position when the operating lever CL is moved by a large amount to the tilt side, and for automatically dumping the bucket 4 as far as a predetermined dump position when the operating lever CL is moved by a large amount to the dump side. By using the automatic drive control, the bucket 4 can be repeatedly operated to a predetermined tilt position and a predetermined dump position easily and accurately by an operator.

However, the operator may nimbly operate the operating lever CL by small increments to the tilt side and the dump side to swing the bucket 4 back and forth in order to even out and mix the load in the bucket 4. In this case, while the operating lever CL may be operated by a large amount by mistake, the controller 25 disables the automatic drive control of the bucket 4 when it is determined that the operator is operating the operating lever CL nimbly in small increments to the tilt side and the dump side. As a result, the operator is able to suppress the automatic drive control of the bucket 4 from starting unintentionally. The operations of the controller 25 are explained hereinbelow.

Actions of Controller 25

The controller 25 tilts the bucket 4 at the driving speed in accordance with the operation amount of the operating lever CL when the operating lever CL is moved to the tilt side, and dumps the bucket 4 at the driving speed in accordance with the operation amount of the operating lever CL when the operating lever CL is moved to the dump side.

The controller 25 executes the "automatic drive control" for automatically tilting the bucket 4 as far as a predetermined tilt position when the operating lever CL is moved by a first tilt operation amount P1 or greater to the tilt side and for automatically dumping the bucket 4 as far as a predetermined dump position when the operating lever CL is moved by a first dump operation amount P1' or greater to the dump side. The driving speed of the bucket 4 during the automatic drive control can be previously set. The first tilt operation amount P1 may be the same value as the first dump operation amount P1' or may be a value different from the first dump operation amount P1'.

The controller 25 detects that the operator intends to tilt the bucket 4 when the operating lever CL is moved by a second tilt operation amount P2 or greater to the tilt side. The second tilt operation amount P2 is larger than zero and can be set to any value within a range that is smaller than the first tilt operation amount P1.

The controller 25 detects that the operator intends to dump the bucket 4 when the operating lever CL is moved by a second dump operation amount P2' or greater to the dump side. The second dump operation amount P2' is larger than zero and can be set to any value within a range that is smaller than the first dump operation amount P1'. The second dump operation amount P2' may be the same value as the second tilt operation amount P2 or may be a value different from the second tilt operation amount P2.

Therefore, the controller 25 starts the tilt operation of the bucket 4 when the operating lever CL is moved to the tilt side. When the operation amount of the operating lever CL reaches the second tilt operation amount P2, the controller 25 detects that the operator intends to tilt the bucket 4, and when the operation amount of the operating lever CL further reaches the first tilt operation amount P1, the controller 25 starts the automatic drive control to the tilt side.

Similarly, the controller 25 starts the dump operation of the bucket 4 when the operating lever CL is moved to the dump side. When the operation amount of the operating lever CL reaches the second dump operation amount P2', the controller 25 detects that the operator intends to dump the bucket 4, and when the operation amount of the operating lever CL further reaches the first dump operation amount P1', the controller 25 starts the automatic drive control to the dump side.

The controller 25 disables the automatic drive control when a switching time period Tc required for switching the operating lever CL from the tilt side to the dump side is equal to or less than a disabling time period Tp, or when the switching time period Tc required for switching the operating lever CL from the dump side to the tilt side is equal to or less than the disabling time period Tp. In the present embodiment, the switching time period Tc is a time period from when the operating lever CL is moved by the second tilt operation amount P2 or greater to the tilt side to when the operating lever CL is moved by the second tilt operation amount P2' or greater to the dump side, or the time period from when the operating lever CL is moved by the second dump operation amount P2' or greater to the dump side to when the operating lever CL is moved by the second tilt operation amount P2 or greater to the tilt side. The disabling time period Tp can be set to a time period that is short enough to still be able to determine that the operator is tilting or dumping the bucket 4 in small increments.

After the automatic drive control has been disabled, the controller 25 enables the automatic drive control again when the switching time period Tc required for switching the operating lever CL from the tilt side to the dump side is equal to or greater than an enabling time period Tq, or when the switching time period Tc required for switching the operating lever CL from the dump side to the tilt side is equal to or less than the enabling time period Tq. The enabling time period Tq can be set to a time period that is long enough to be able to determine that the operator is not tilting or dumping the bucket 4 in small increments. The enabling time period Tq is set to be a value larger than the disabling time period Tp.

Figure 3A:
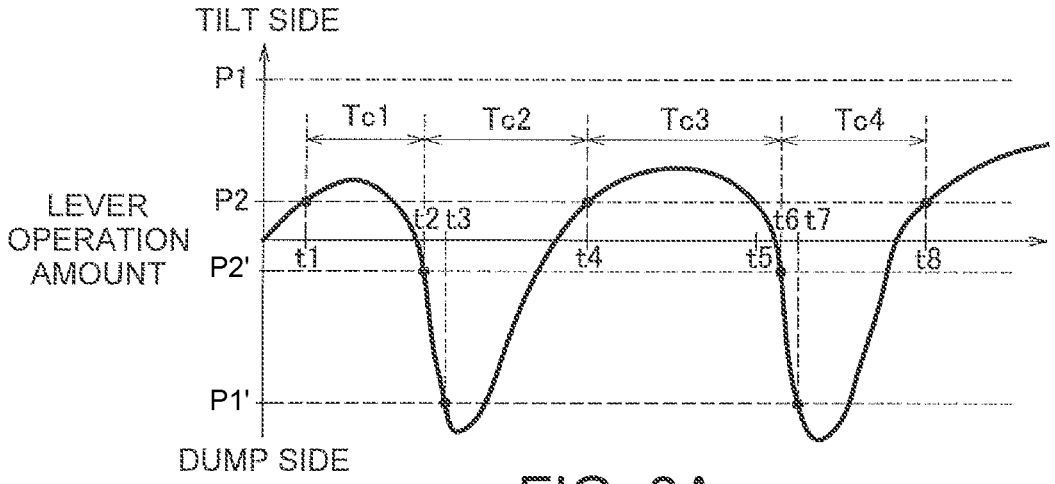
FIGS. 3A, 3B and 3C are graphs for explaining an example of the actions of a controller.
Figure 3B:
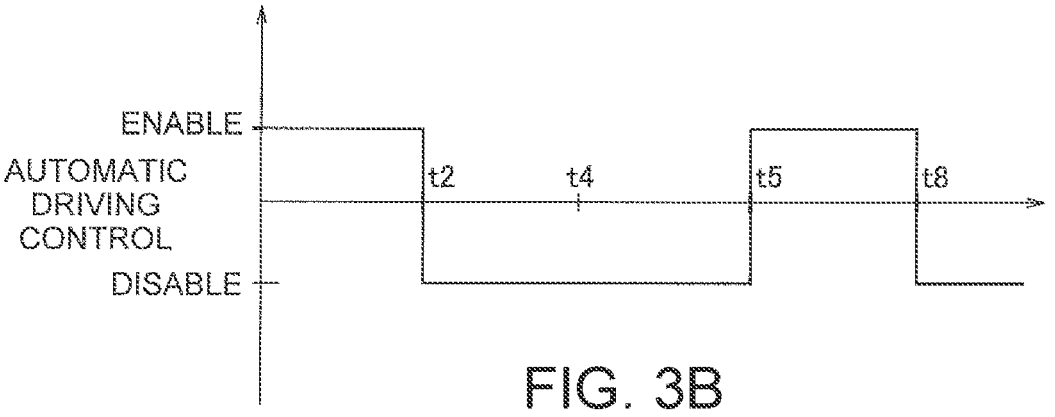
Figure 3C:
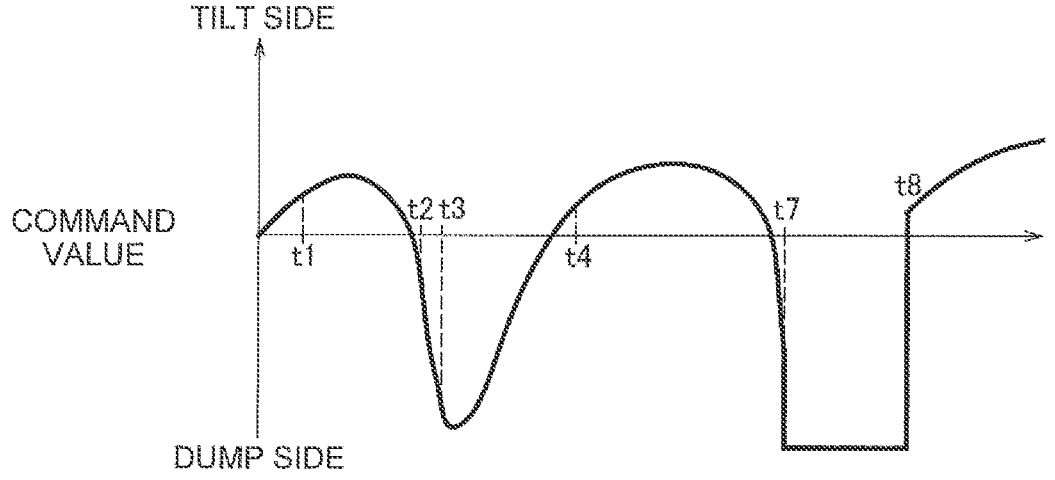

A detailed example of the actions of the controller 25 as described above will be explained with reference to FIGS. 3A-3C. FIG. 3A is a graph indicating operation amounts of the operating lever CL. FIG. 3B is a graph indicating enable and disable states of the automatic drive control. FIG. 3C is a graph indicating command values from the controller 25 to the bucket dump control valve 24*c* and the bucket tilt control valve 24*d*. In the following explanation, the processing starts from a state in which the automatic drive control has been enabled.

Between times t0 to t1, the operation amount of the operating lever CL to the tilt side is gradually increased (FIG. 3A). At the time t1, the operation amount of the operating lever CL to the tilt side reaches the second tilt operation amount P2 (FIG. 3A).

Between times t1 to t2, after the operation amount to the tilt side has reached the second tilt operation amount P2, the operating lever CL is moved back and the operation amount to the dump side reaches the second dump operation amount P2' (FIG. 3A). The "first switching time period Tc1" from the time t1 to the time t2 is equal to or less than the disabling time period Tp. The controller 25 then determines that the operator is swinging the bucket back and forth at the time t2 and disables the automatic drive control of the bucket 4

(FIG. 3B). As a result, at the time t3, although the operation amount to the dump side reaches the first dump operation amount P1' (FIG. 3A), the controller 25 does not execute the automatic drive control and drives the bucket 4 in response to the operation of the operating lever CL from the time t3 onward (FIG. 3C). In this way, even when the operator moves the operating lever CL excessively by mistake, the operator is able to continue swinging the bucket 4 because the automatic drive control is disabled.

Between times t2 to t4, after the operation amount to the dump side has reached the second dump operation amount P2', the operating lever CL is moved back and the operation amount to the tilt side reaches the second tilt operation amount P2 (FIG. 3A). A "second switching time period Tc2" from time t2 to time t4 is equal to or less than the disabling time period Tp. At the time t4, the controller 25 then continues the disablement of the automatic drive control of the bucket 4 without enabling the automatic drive control (FIG. 3B). Even if the "second switching time period Tc2" is greater than the disabling time period Tp, the controller 25 continues the disablement if the "second switching time period Tc2" is less than the enabling time period Tq.

Between times t4 to t6, after the operation amount to the tilt side has reached the second tilt operation amount P2, the operating lever CL is moved back and the operation amount to the dump side reaches the second dump operation amount P2' (FIG. 3A). A "third switching time period Tc3" from the time t4 to the time t6 is equal to or greater than the predetermined enabling time period Tq and the enabling time period Tq has elapsed at the time t5 (FIG. 3A). The controller 25 then determines that the operator is not swinging the bucket back and forth at the time t5 and enables the automatic drive control of the bucket 4 again (FIG. 3B). As a result, at the time t7, the controller 25 executes the automatic drive control (FIG. 3C) in response to the operation amount to the dump side reaching the first dump operation amount P1' (FIG. 3A).

Between times t6 to t8, after the operation amount to the dump side has reached the second dump operation amount P2', the operating lever CL is moved back and the operation amount to the tilt side reaches the second tilt operation amount P2 (FIG. 3A). A "fourth switching time period Tc4" from the time t6 to the time t8 is equal to or less than the disabling time period Tp. At the time t8, the controller 25 then disables the automatic drive control of the bucket 4 again (FIG. 3B).

(Automatic Drive Control)

Figure 4:
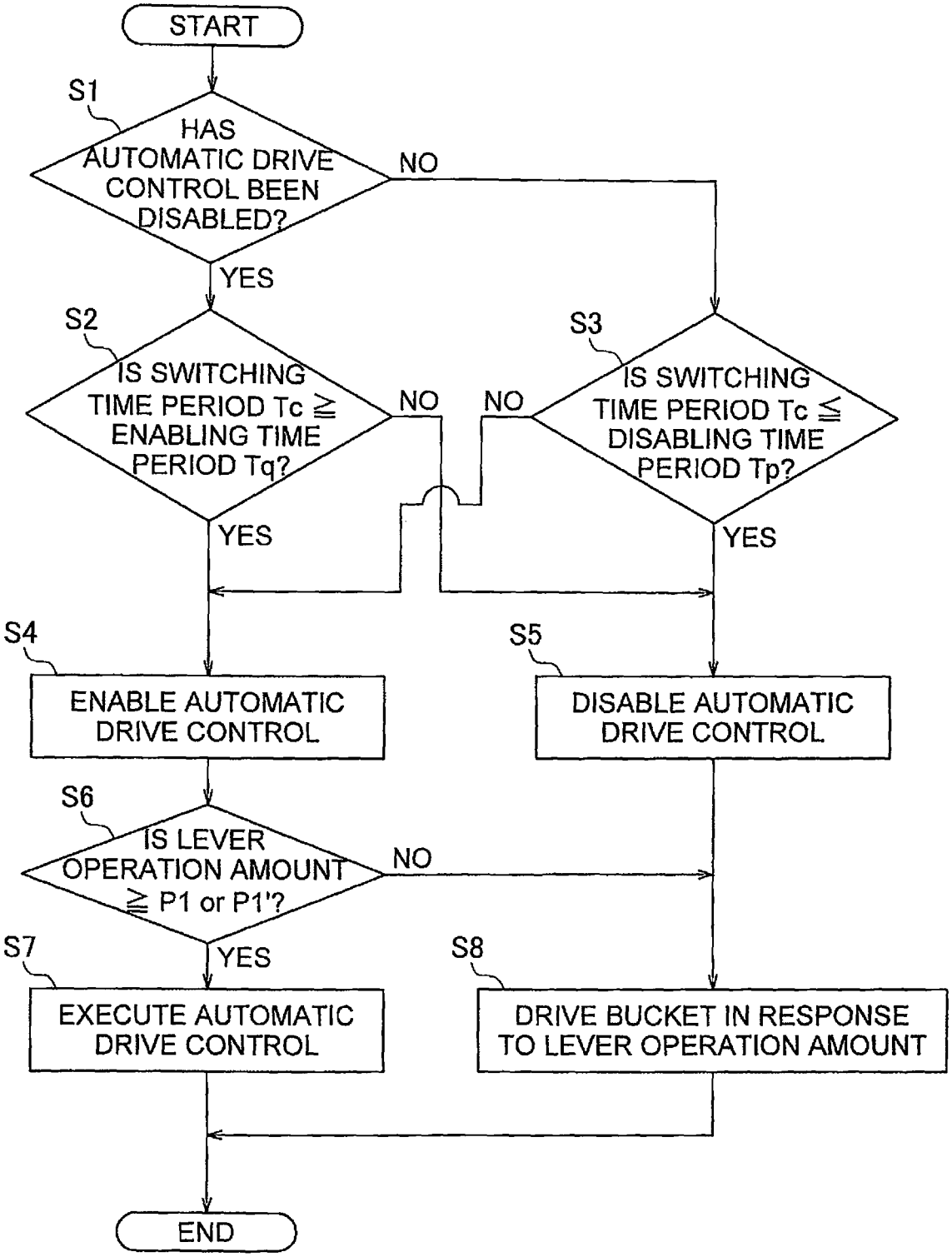
FIG. 4 is a flow chart for explaining an automatic drive control.

The automatic drive control performed by the controller 25 will be explained with reference to the flow chart illustrated in FIG. 4.

In step S1, the controller 25 determines whether the automatic drive control has been disabled. If the automatic drive control has been disabled, the processing advances to step S2. If the automatic drive control has not been disabled, that is, when the automatic drive control is enabled, the processing advances to step S6.

In step S2, the controller 25 determines whether the switching time period Tc is equal to or greater than the enabling time period Tq in order to determine the need for enabling. If the switching time period Tc is equal to or greater than the enabling time period Tq, the processing advances to step S4 and the controller 25 enables the automatic drive control. If the switching time period Tc is not equal to or greater than the enabling time period Tq, the processing advances to step S5 and the controller 25 maintains the disablement of the automatic drive control.

In step S3, the controller 25 determines whether the switching time period Tc is equal to or less than the disabling time period Tp in order to determine the need for disablement. If the switching time period Tc is not equal to or less than the disabling time period Tp, the processing advances to step S4 and the controller 25 maintains the enablement of the automatic drive control. If the switching time period Tc is equal to or less than the disabling time period Tp, the processing advances to step S5, and after the controller 25 has disabled the automatic drive control, the bucket 4 is driven in response to the operation amount of the operating lever CL in step S8.

After step S4, the processing advances to step S6 and the controller 25 determines whether the operation amount of the operating lever CL is equal to or greater than the first tilt operation amount P1, or equal to or greater than the first dump operation amount P1'. If the operation amount of the operating lever CL is equal to or greater than the first tilt operation amount P1, or equal to or greater than the first dump operation amount P1', the processing advances to step S7 and the controller 25 executes the automatic drive control. If the operation amount of the operating lever CL is not equal to or greater than the first tilt operation amount P1, or not equal to or greater than the first dump operation amount P1', the processing advances to step S8 and the controller 25 drives the bucket 4 in response to the operation amount of the operating lever CL.

While the controller 25 executes the automatic drive control when the operating lever CL is moved by the first tilt operation amount P1 or greater to the tilt side, or when the operating lever CL is moved by the first dump operation amount P1' or greater to the dump side in the above embodiment, the execution starting condition of the automatic drive control is not limited in this way. For example, the controller 25 may execute the automatic drive control when the operating lever CL is returned to the neutral position after the operating lever CL has been moved by the first tilt operation amount P1 or greater to the tilt side, or after the operating lever CL has been moved by the first dump operation amount P1' or greater to the dump side.

While the switching time period Tc is used as the time period from when the operating lever CL is moved by the second tilt operation amount P2 or greater to the tilt side to when the operating lever CL is moved by the second tilt operation amount P2' or greater to the dump side, or the time period from when the operating lever CL is moved by the second dump operation amount P2' or greater to the dump side to when the operating lever CL is moved by the second tilt operation amount P2 or greater to the tilt side in the above embodiment, the present invention is not limited in this way. The time period from when the operation amount of the operating lever CL to the tilt side is equal to or less than the second tilt operation amount P2 to when the operation amount to the dump side becomes the second dump operation amount P2' or greater, or the time period from when the operation amount of the operating lever CL to the dump side is equal to or less than the second dump operation amount P2' to when the operation amount to the tilt side becomes the second tilt operation amount P2 or greater, may each be used as the switching time period Tc.

While the controller 25 tilts or dumps the bucket 4 at the same time as the operating lever CL is moved from the neutral position to the tilt side or the dump side in the above embodiment, the present invention is not limited in this way. A neutral region of a predetermined range centered on the neutral position may be set in the operating lever CL. In this case, the controller 25 tilts the bucket 4 when the operating lever CL is moved out of the neutral region to the tilt side, and dumps the bucket 4 when the operating lever CL is moved out of the neutral region to the dump side. The neutral region may be the same as or may be different from the range from the second tilt operation amount P2 to the second dump operation amount P2'.

While the controller 25 executes the automatic drive control in both the tilt side direction and the dump side direction in the above embodiment, the automatic drive control may be executed for only one of the tilt side and the dump side.

What is claimed is:

1. A work vehicle comprising:

a vehicle body;

a work implement attached to the vehicle body, the work implement including an attachment;

an operating device configured to be operated to a dump side to cause the attachment to dump and to a tilt side to cause the attachment to tilt, the dump side and the tilt side being different from each other;

a detector configured to detect an operation amount by which the operating device is operated; and a controller configured to receive the operation amount from the detector and execute an automatic drive control in which the attachment is caused to automatically dump as far as a predetermined dumping position when the operating device is operated by a first dump operation amount or greater to the dump side, or the attachment is caused to automatically tilt as far as a predetermined tilt position when the operating device is operated by a first tilt operation amount or greater to the tilt side, the controller being further configured to determine that an operator is swinging the work implement back and forth and put the automatic drive control into a disabled state in response to detecting that the operating device has been operated such that a switching time period is equal to or less than a predetermined disabling time period, during the disabled state the automatic control not being executed even if the lever is operated by the first dump operation amount or greater to the dump side or by the first tilt operation amount or greater to the tilt side, the controller determining the switching time period based on the operation amount detected by the detector when the operating device is switched from the tilt side to the dump side or from the dump side to the tilt side, the switching time period being an amount of time from when the operating device reaches a position corresponding to a second tilt operation amount on the tilt side while being operated toward the tilt side until the operating device reaches a position corresponding to a second dump operation amount on the dump side while being operated toward the dump side, or an amount of time from when the operating device reaches the position corresponding to the second dump operation amount on the dump side while being operated toward the dump side until the operating device reaches the position corresponding to the second tilt operation amount on the tilt side while being operated toward the tilt side, the second tilt operation amount being smaller than the first tilt operation amount and the second dump operation amount being smaller than the first dump operation amount.

2. The work vehicle according to claim 1, wherein after the controller has disabled the automatic drive control due to the switching time period being the disabling time period or less, the controller is further configured to enable the automatic drive control when a subsequent switching time period is determined to be a predetermined enabling time period or greater.

3. The work vehicle according to claim 2, wherein the enabling time period is longer than the disabling time period.

4. A control method for a work vehicle configured to execute an automatic drive control to automatically cause an attachment to dump as far as a predetermined dump position when an operating device is operated by a first dump operation amount or greater to a dump side, or to automatically cause the attachment to tilt as far as a predetermined tilt position when the operating device is operated by a first tilt operation amount or greater to a tilt side, the dump side and the tilt side being different from each other, the method comprising:

detecting an operation amount of the operating device;

determining that an operator is swinging the work implement back and forth and putting the automatic drive control into a disabled state in response to detecting that the operating device has been operated such that a switching time period is equal to or less than a predetermined disabling time period, determining the switching time period based on the operation amount when the operating device is switched from the tilt side to the dump side or from the dump side to the tilt side, the switching time period being an amount of time from when the operating device reaches a position corresponding to a second tilt operation amount on the tilt side while being operated toward the tilt side until the operating device reaches a position corresponding to a second dump operation amount on the dump side while being operated toward the dump side, or an amount of time from when the operating device reaches the position corresponding to the second dump operation amount on the dump side while being operated toward the dump side until the operating device reaches the position corresponding to the second tilt operation amount on the tilt side while being operated toward the tilt side, the second tilt operation amount being smaller than the first tilt operation amount and the second dump operation amount being smaller than the first dump operation amount; and while the automatic drive control is in the disabled state, driving the attachment in response to an operation of the operating device and not executing the automatic control even if the lever is operated by the first dump operation amount or greater to the dump side or by the first tilt operation amount or greater to the tilt side.

5. The control method for a work vehicle according to claim 4, the method further comprising after driving the attachment, enabling the automatic drive control when a subsequent switching time period has become a predetermined enabling time period or greater after the switching time period has become the disabling time period or less.

6. The control method for a work vehicle according to claim 5, wherein the enabling time period is longer than the disabling time period.

7. The control method for a work vehicle according to claim 4, further comprising:

detecting an operation amount of the operating device; and controlling the work implement to dump the attachment at a driving speed in accordance with the operation amount when the operating device is operated to the dump side and the operation amount is smaller than the first dump operation amount, or tilt the attachment at a driving speed in accordance with the operation amount when the operating device is operated to the tilt side and the operation amount is smaller than the first tilt operation amount.

8. The work vehicle according to claim 1, wherein the controller is configured to dump the attachment at a driving speed in accordance with the operation amount when the operating device is operated to the dump side and the operation amount is smaller than the first dump operation amount, and the controller is configured to tilt the attachment at a driving speed in accordance with the operation amount when the operating device is operated to the tilt side and the operation amount is smaller than the first tilt operation amount.

9. The work vehicle according to claim 1, wherein the operating device has a neutral position disposed between the position corresponding to the second dump operation amount and the position corresponding to the second tilt operation amount, and switching of the operating device from the tilt side to the dump side or from the dump side to the tilt side includes passing through the neutral position.

10. The work vehicle according to claim 1, wherein the operating device is an operating lever.

11. The control method for a work vehicle according to claim 4, wherein the operating device used in the method is configured to have a neutral position disposed between the position corresponding to the second dump operation amount and the position corresponding to the second tilt operation amount such that switching of the operating device from the tilt side to the dump side or from the dump side to the tilt side includes passing through the neutral position.

12. The control method for a work vehicle according to claim 11, wherein the first dump operation amount, the first tilt operation amount, the second dump operation amount, and the second tilt operation amount are measured from the neutral position.

13. The work vehicle according to claim 9, wherein the first dump operation amount, the first tilt operation amount, the second dump operation amount, and the second tilt operation amount are measured from the neutral position.

* * * * *